US009282385B2

(12) United States Patent
Casset et al.

(10) Patent No.: US 9,282,385 B2
(45) Date of Patent: Mar. 8, 2016

(54) DIGITAL LOUDSPEAKER WITH ENHANCED PERFORMANCE

(71) Applicant: COMMISSARIAT A L'ENERGIE ATOMIQUE ET AUX ENE ALT, Paris (FR)

(72) Inventors: Fabrice Casset, Tencin (FR); Remy Dejaeger, Eveux (FR)

(73) Assignee: Commissariat à l'énergie automique et aux énergies alternatives, Paris (FR)

( * ) Notice: Subject to any disclaimer, the term of this patent is extended or adjusted under 35 U.S.C. 154(b) by 0 days.

(21) Appl. No.: 13/887,707

(22) Filed: May 6, 2013

(65) Prior Publication Data

US 2013/0294636 A1 Nov. 7, 2013

(30) Foreign Application Priority Data

May 7, 2012 (FR) ..... 12 54172

(51) Int. Cl.

| | |
|---|---|
| ***H04R 25/00*** | (2006.01) |
| ***H04R 1/02*** | (2006.01) |
| ***H04R 1/00*** | (2006.01) |
| *H04R 1/40* | (2006.01) |
| *H04R 17/00* | (2006.01) |

(52) U.S. Cl.

CPC ..... *H04R 1/02* (2013.01); *H04R 1/005* (2013.01); *H04R 1/406* (2013.01); *H04R 17/00* (2013.01)

(58) Field of Classification Search

USPC ..... 381/190, 114, 173, 431

See application file for complete search history.

(56) References Cited

U.S. PATENT DOCUMENTS

| | | | | |
|---|---|---|---|---|
| 4,330,686 | A | 5/1982 | Roe | |
| 5,867,302 | A | 2/1999 | Fleming | |
| 6,278,790 | B1 * | 8/2001 | Davis et al. | 381/398 |
| 6,865,785 | B2 * | 3/2005 | Ogura et al. | 29/25.35 |
| 7,489,228 | B2 | 2/2009 | Robert | |
| 2002/0015507 | A1 * | 2/2002 | Harris | H04R 7/045 381/431 |
| 2002/0106093 | A1 * | 8/2002 | Azima et al. | 381/111 |
| 2006/0279174 | A1 | 12/2006 | Oliver et al. | |
| 2007/0188846 | A1 * | 8/2007 | Slicker et al. | 359/290 |
| 2008/0123242 | A1 | 5/2008 | Zhou | |
| 2010/0002900 | A1 | 1/2010 | Cohen et al. | |

(Continued)

FOREIGN PATENT DOCUMENTS

| | | | |
|---|---|---|---|
| EP | 1 206 160 | A1 | 5/2002 |
| WO | WO 2007/135680 | A1 | 11/2007 |
| WO | WO 2011/051985 | A1 | 5/2011 |

OTHER PUBLICATIONS

French Preliminary Search Report issued Jan. 16, 2013, in French Application No. 12 54172 filed May 7, 2012.

Long Que et al., "A Bi-Stable Electro-Thermal RF Switch for High Power Applications", Micro Electro Mechanical Systems, 17th IEEE International Conference, (MEMS), 2004, pp. 797-800.

(Continued)

*Primary Examiner* — Davetta W Goins

*Assistant Examiner* — Amir Etesam

(74) *Attorney, Agent, or Firm* — Oblon, McClelland, Maier & Neustadt, L.L.P.

(57) ABSTRACT

Digital loudspeaker comprising a support, a plurality of first membranes suspended on the support, said first membranes being bistable, and said loudspeaker comprising actuator for each of the first membranes that can change each of the first membranes from a first stable state to a second stable state and vice versa, and a controller for controlling said first actuator.

19 Claims, 8 Drawing Sheets

(56) References Cited

U.S. PATENT DOCUMENTS

| | | | | |
|---|---|---|---|---|
| 2010/0166242 | A1 | 7/2010 | Cohen et al. | |
| 2010/0260360 | A1 * | 10/2010 | Strub | 381/303 |
| 2011/0051985 | A1 | 3/2011 | Hwang et al. | |
| 2014/0177881 | A1 | 6/2014 | Fanget et al. | |

OTHER PUBLICATIONS

Gatien Fleury et al., "Modélisation Analytiqe et par Éléments Finis de la Bistabilité d'une Poutre Flambée pour Applications Microsystèmes", 17*eme* Congrès Français de Mécanique, CFM 2005, 6 pages, (with English Abstract).

* cited by examiner

DIGITAL LOUDSPEAKER WITH ENHANCED PERFORMANCE

TECHNICAL DOMAIN AND PRIOR ART

This invention relates to a digital loudspeaker with enhanced performance.

Loudspeakers are present in many types of equipment such as mobile phones, flat screens, etc. and an attempt is made to miniaturise them. MEMS technologies can give ultrathin loudspeakers.

The MEMS technology is particularly advantageous for making digital loudspeakers for which the large membrane of the analogue loudspeaker is replaced by several small individual membranes called speaklets capable of reproducing the sound.

In the case of a digital loudspeaker, each speaklet is actuated individually by actuating the speaklets in a high position or in a low position, depending on the sound to be reproduced.

Document WO 2011/0051985 discloses a loudspeaker in which membranes are moved by piezoelectric means. The membranes move upwards or downwards and then oscillate around the equilibrium position when the actuation signal stops. This return to equilibrium is accompanied by a parasite oscillation that can disturb the audible sound.

Document WO 2007/135680 discloses a digital loudspeaker in which the membranes are moved by magnetic means and are held in a high position or a low position through electrostatic means. Parasite oscillations are then reduced, however holding in this position requires energy because the electrostatic means have to be powered, which is particularly problematic in the case of portable devices.

PRESENTATION OF THE INVENTION

Consequently, one purpose of this invention is to disclose a digital loudspeaker with enhanced performance, more particularly in which the membranes have no or very little parasite oscillation with low electricity consumption.

The purpose described above is achieved with a loudspeaker comprising at least a matrix of several suspended membranes, an actuator associated with each membrane to move it upwards or downwards in which each of the membranes are formed by a bistable element.

A "bistable element" according to this application refers to an element with two stable states, the change from one stable state to the other being achieved by means of an actuator that applies a force on the element. The bistable element remains in each of its stable positions when the actuator stops applying a force and without the help of other outer device.

Thus, the membranes are always in one of their stable states, and when the membranes are moved under the action of the actuator, they move into their other stable state with minimum parasite oscillation so that this oscillation is very much reduced. Therefore, the loudspeaker performances are improved.

Furthermore, the type of displacement of the flip flop is close to the ideal displacement in the case of a digital loudspeaker.

Furthermore, membranes remain in one or their stable states without any added energy. Therefore the electricity consumption of the loudspeaker is low, which is particularly useful in the case of portable systems.

Particularly advantageously, the loudspeaker comprises a first group of bistable membranes and a second group of bistable membranes that can be controlled separately. In the initial state, the membranes in each group may either be in opposite stable states or in the same stable state.

The subject-matter of this invention is a digital loudspeaker comprising a support, a plurality of first membranes suspended on the support, said first membranes being bistable, said loudspeaker comprising first actuation means for each of the first membranes that can change each of the first membranes from a first stable state to a second stable state and vice versa, and means of controlling said first actuation means.

The membranes can thus be controlled independently of each other or by independent groups. When a group of membranes is controlled together, the actuation means of these membranes are connected to each other. For example in the case of a piezoelectric actuation, all upper (or lower) electrodes may be connected to each other.

Particularly advantageously, the first membranes form a first group of membranes and the loudspeaker comprises at least one second group of second membranes and second actuation means for each of the second membranes, the first and the second actuation means being controlled separately by the control means. Initially, the first membranes and the second membranes may be either in different stable states or in the same stable state.

The number of first membranes and the number of second membranes are equal, this embodiment is advantageous but is not necessary.

According to a supplementary characteristic, the control means can send a reinitialisation signal to the first and/or the second membranes before a control signal is sent to change said membranes into one of said first and second stable states.

In one example embodiment, the first and/or second actuation means are of the piezoelectric type, each one comprising at least one element made of piezoelectric material in contact with each of the membranes and control electrodes associated with each piezoelectric element capable of applying a control voltage to each element made of a piezoelectric material.

In another embodiment, the actuation means may be formed from several actuators made of ferroelectric material, one actuator being in the form of a ring around the edge of the membrane and an actuator at the centre of the membrane, the upwards or downwards displacement of the membrane being achieved by activating one of the actuators.

In another embodiment, the first and/or second actuation means are of the thermal type, comprising an element forming an electrical resistance controlled by control means and arranged in contact with each of the membranes, each electrical resistance being capable of applying a mechanical torque to the membrane associated with it.

In another embodiment, the first and/or second actuation means are magnetic.

Advantageously, the piezoelectric element arranged on the membrane has a surface area equal to between 0.4 and 0.6 times the surface area of the membrane.

The digital loudspeaker may advantageously be made using microelectronic methods.

Another subject-matter of the invention is a method for making a loudspeaker according to the invention comprising the following steps:

a) make a layer in which the membranes will be formed on a substrate, b) make first and/or second actuation means, c) release the membranes, d) connect the first and/or second actuation means to the control means.

The layer formed in step a) may be made with at least one predefined stress level.

During step a), the different predetermined stress levels are advantageously applied to different zones in the layer that will form the membranes so as to form the first and second membranes that will be in different stable states when they are released in step c).

Between step c) and step d), a step to cut out the device obtained may take place to form two sub-elements or membrane groups, and during step d) the two sub-elements may be assembled and the first and second actuation means may be electrically connected to the control means such that the membranes of the two sub-elements are in different stable states.

One of the sub-assemblies may be turned over.

Preferably, part of the actuation means is actuated to force the membranes associated with said actuation means to change to the other stable state.

"Part of the actuation means" refers to either part of a single group of membranes or all or part of another group of membranes.

BRIEF DESCRIPTION OF THE DRAWINGS

This invention will be better understood after reading the following description and the appended drawings in which.

DETAILED DISCLOSURE OF PARTICULAR EMBODIMENTS

Figure 1:
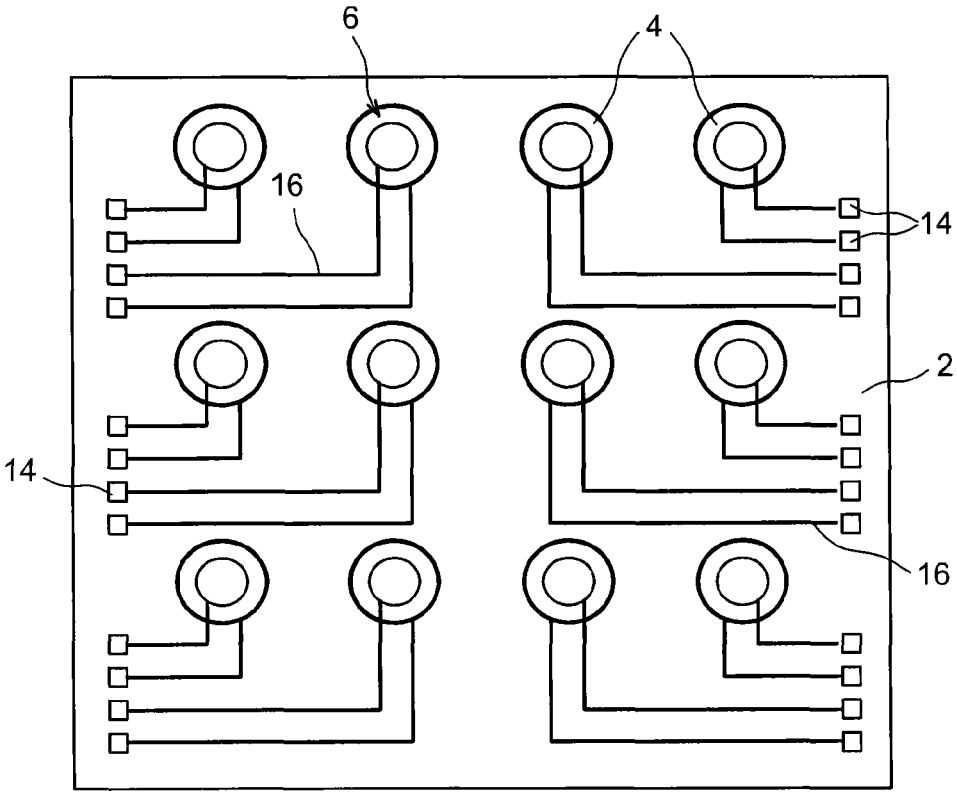
FIG. 1 is a diagrammatic top view of a first embodiment of a digital loudspeaker according to the invention.

FIG. 1 shows a top view of a digital loudspeaker comprising a support 2 and a plurality of membranes 4 suspended above the support 2. The loudspeaker also comprises individual means of actuating each membrane 4. These means may be electrostatic, magnetic, thermal, piezoelectric, etc. A digital loudspeaker usually comprises of the order of one to several hundred speaklets.

Figure 2:
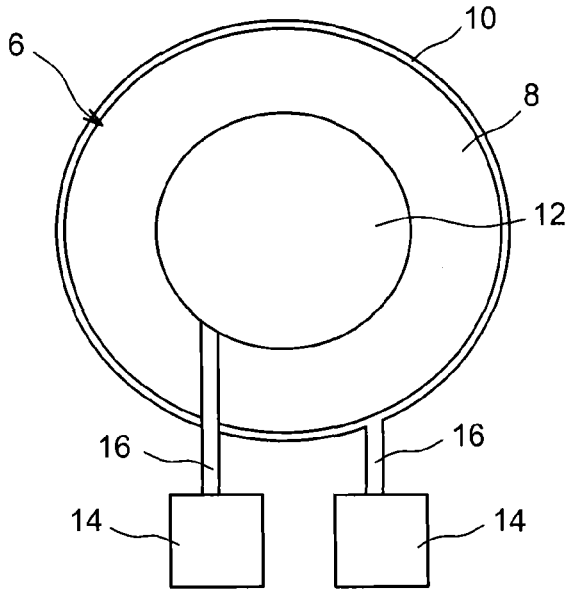
FIG. 2 is a top view of an example embodiment of a membrane that can be used in the loudspeaker in FIG. 1.

FIG. 2 shows a top view of a membrane 4 and piezoelectric actuation means 6.

Preferably, membrane 4 is in the form of a disk suspended around its periphery. The piezoelectric actuation means 6 are formed by a disk 8 made from a piezoelectric material arranged on one of the faces of the membrane 4. The actuation means also comprise electrodes 10, 12 called the lower and upper electrodes formed on the piezoelectric material 8 and under the piezoelectric material 8 respectively, the electrodes 10, 12 are connected to a voltage source (not shown). The pairs of electrodes 10, 12 for each membrane 4 are individually connected to the voltage source and application of a voltage is controlled individually. In some systems, speaklets can be assembled by bit to form groups of speaklets.

As a variant, the shape of the membrane may be elliptical or polygonal.

In this example embodiment, the actuators are made from piezoelectric materials for example such as AlN, ZnO, etc. A positive voltage causes expansion of the piezoelectric material while a negative voltage causes its contraction. Thus, upwards and downwards displacements can be achieved using a single actuator.

The lower electrode 10 may be circular in shape with the same surface area as the membrane, or it may have a smaller surface area or it may have a shape different from the shape of the membrane.

For example, the radius of the suspended part Rm of the membrane may be between 100 μm and 7500 μm, which is also the radius of the piezoelectric material and the lower electrode in the example shown. The radius of the upper electrode Re may be between 10 μm and 7480 μm.

Advantageously, the surface area of the upper electrode 12 may be chosen to cover between 40% and 60% of the surface area of the membrane.

Connecting pads 14 and electrical conductors 16 connecting the pads to the electrodes 10, 12 are also shown diagrammatically. The pads are preferably located around the periphery of the matrix of speaklets and are connected to the electrodes through tracks. These pads are generally connected to the voltage source through a wire (not shown).

The membrane 4 forms a bistable element and its concavity in each of its stable states is opposite to its concavity in the other stable state. Mechanically, the membrane 4 is embedded in the support 2 and application of a stress on the membrane 4 creates a stress at the embedment. Starting from a threshold stress, the system suddenly changes from one stable state to the other and the membrane then accelerates quickly and therefore generates a high acoustic pressure.

Figure 3A:
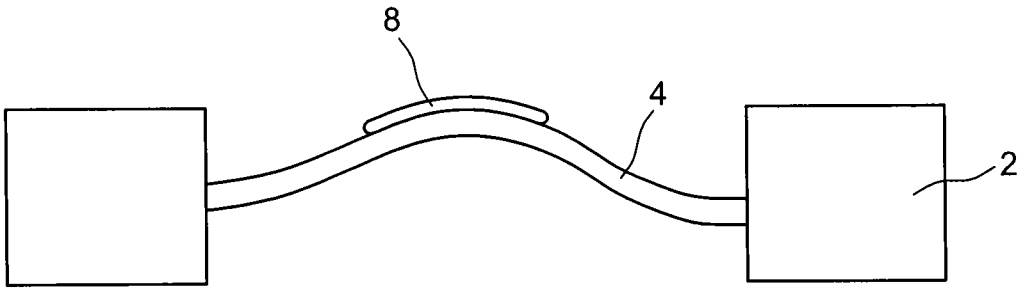
FIGS. 3A to 3E are side views of a bistable membrane of a loudspeaker according to the invention in different states.
Figure 3B:
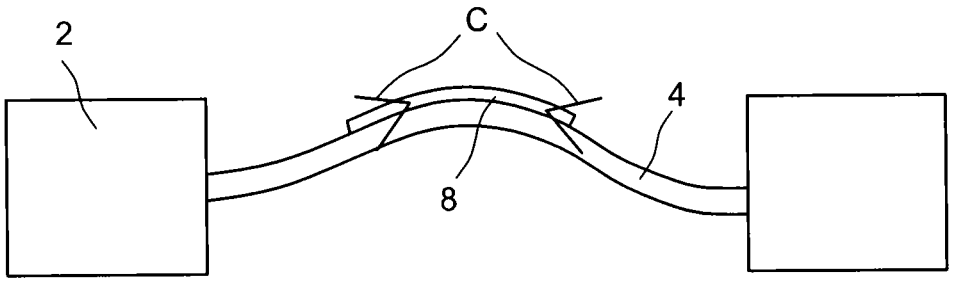
Figure 3C:
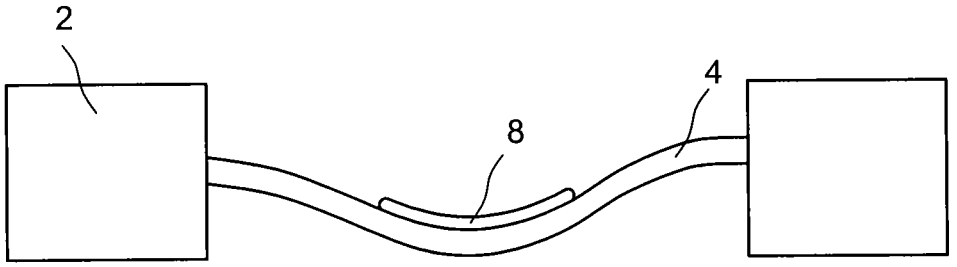
Figure 3D:
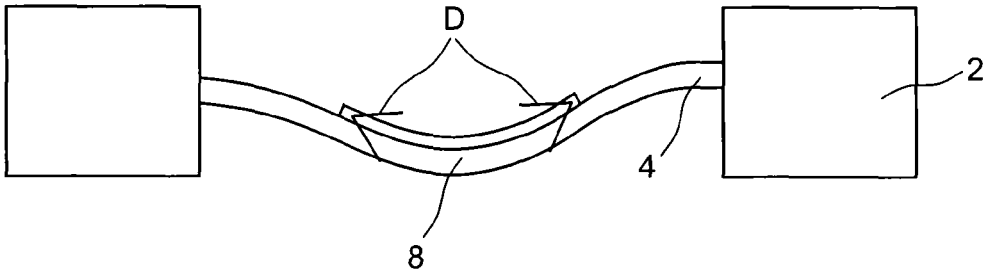

FIG. 3A shows a sectional view of the membrane 4 in a first stable state with downwards concavity, and FIG. 3C shows the membrane in its second stable state with upwards concavity.

The unit acoustic pressure generated by displacement of the membrane from the first stable state to the second stable state, i.e. from the top downwards in the example shown, is called a " negative pulse" and the unit acoustic pressure generated by displacement of the membrane from the second stable state to the first stable state, i.e. from the bottom upwards in the example shown, is called the "positive pulse". The negative pulse and the positive pulse are preferably symmetric about the abscissa axis, if the pressure pulses are shown as a function of time.

Thus, the control electronics sends a signal to generate one of the two pulses depending on the sound to be reproduced.

The convex shape of the membrane may be produced during fabrication. For example, during production of the membrane by deposition for example by chemical vapour deposition (CVD) or by PCVD or by growth, it is made with a predetermined compression stress that depends partly on deposition conditions, for example the deposition temperature, the deposition rate and the gases used, and partly on the composition of the material from which the membrane is made. The convex shape of the membrane may be achieved by adjusting the compression stress in one or several of the constituent layers of the membrane. When the membrane is released, it is in one of its stable states.

We will now refer to FIGS. 3A to 3E to describe the change of a bistable membrane in a loudspeaker according to the invention from one stable state to the other.

In FIG. 3A, the membrane 4 is in its first stable state. No voltage is applied to the piezoelectric material 8.

When it is required to generate an acoustic pressure resulting from a negative pulse, a negative voltage is applied to the piezoelectric material 8 which contracts (contraction is symbolized by the two arrows C), which has the effect of causing downwards displacement of the membrane 4 due to the bimetallic strip type effect (the membrane and the piezoelectric material forming a mechanical bimetallic strip) moving it into its second stable position (FIG. 3C). As the membrane 4 moves, it displaces air around the membrane 4 and generates a unit acoustic pressure of a speaklet.

When the membrane 4 reaches its second stable state, the voltage is no longer applied to the piezoelectric material 8 that returns to its initial size but with concavity opposite to what it had when the membrane 4 was in its first equilibrium position.

When it is required to generate an acoustic pressure resulting from a positive pulse, a positive voltage is once again applied to the piezoelectric material 8 that expands (FIG. 3D; expansion is symbolized by the two arrows D), which causes upwards displacement of the membrane 4 by the bimetallic strip type effect, into its first bistable position. As the membrane 4 moves, it displaces air around the membrane and generates a unit acoustic pressure of a speaklet.

Figure 3E:
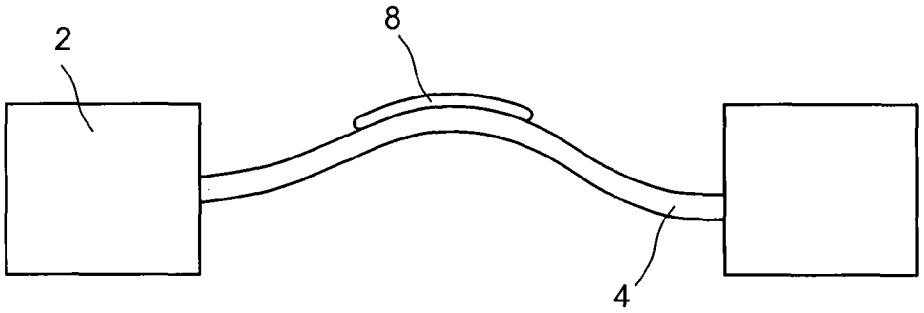

When the membrane 4 reaches its first stable state, the voltage is no longer applied to the piezoelectric material 8 that returns to its original size, this state is shown in FIG. 3E that is identical to the state in FIG. 3A.

As a variant, the actuator 6 could be envisaged in the form of a ring surrounding the membrane. Operation is then inverted, application of a positive voltage causing expansion of the ring moves the membrane downwards and generates a negative pulse, and application of a negative voltage causing contraction of the ring moves the membrane upwards and generates a positive pulse.

In the example in FIG. 1, all the membranes are in the same state at the beginning of use. The speaklets are controlled simultaneously as described above to cause a plurality of unit acoustic pressures that form an acoustic pressure of the loudspeaker generating a given audible sound.

The speaklets are controlled by control electronics well known to those skilled in the art and that will not be described in detail. This electronics controls the power supply voltage, the voltage applied to each of the actuators 6 to cause or not cause a state change.

With the invention, the unit acoustic pressure by a bistable membrane for a given membrane surface area is greater than the pressure generated by a membrane according to the state of the art. The bistable membrane is stiffer than membranes according to the state of the art, due to internal stresses responsible for the bistable effect, which induces a higher resonant frequency and greater acceleration during displacement of the membrane from one of its stable states to the other. Since the acoustic pressure is directly proportional to the acceleration, the acoustic pressure is increased.

In the embodiment in FIG. 1, the loudspeaker comprises a matrix of speaklets in which all membranes 4 are in the same initial state, for example in the first stable state. If the control electronics firstly requires an acoustic pressure resulting from a negative pulse, a signal is sent to the actuators to move the membranes downwards.

If subsequently the control electronics requests an acoustic pressure resulting from a positive pulse, a signal is sent to the actuators to shift the membranes upwards.

If the control electronics firstly requires an acoustic pressure resulting from a positive pulse the membranes are not in the appropriate stable state. In this case, the control electronics sends a preliminary reinitialisation signal to move the membranes towards their second stable state, and then sends a signal to cause the changeover from the second stable state to return to the first state and generate the required acoustic pressure.

Similarly, if the control electronics requests the same signal twice, i.e. generate an acoustic pressure resulting from a negative or positive pulse twice, the membranes will not be in the appropriate state at the time of the second command. In this case, the control electronics also sends a reinitialisation signal so that the membranes change state before being actuated to generate the required acoustic pressure.

This is a very simple method, nevertheless, it should be noted that this reinitialisation step can induce an acoustic parasite due to the acoustic pressure generated during reinitialisation. Nevertheless, this is a case that occurs very rarely.

Figure 4:
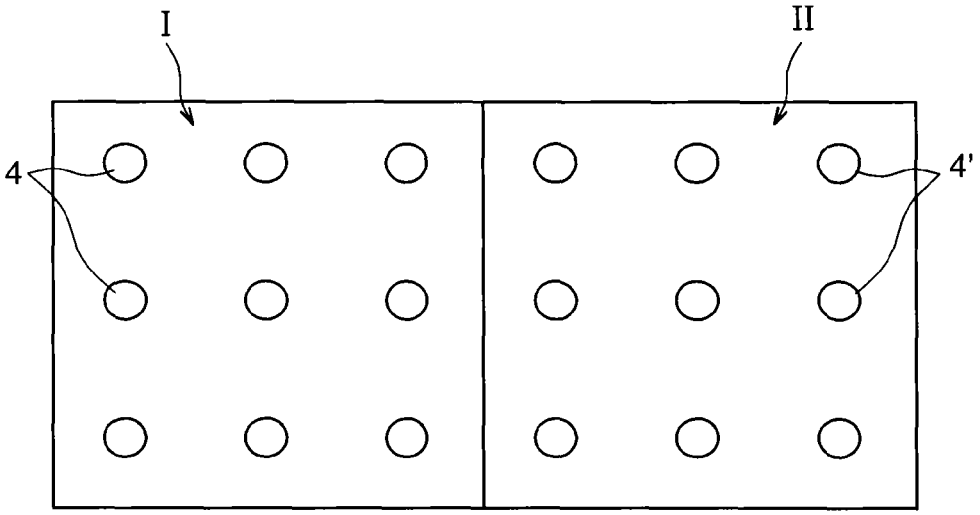
FIG. 4 is a top view of a second embodiment of a digital loudspeaker shown diagrammatically comprising two groups of bistable membranes.

Very advantageously, the loudspeaker comprises at least two groups I, II of separately controlled bistable membranes 4, 4' respectively, as shown in FIG. 4. In the embodiment shown, the membranes 4, 4' of the two groups I, II have opposite stable states in the initial state.

Thus, there is a group of membranes in the required stable state. If it is considered that the first group I is in the first stable state and the second group II is in the second stable state, then group I will be actuated if the control electronics commands a negative pulse, and group II will be actuated if it commands a positive pulse.

In the case in which the control electronics sends the same control signal twice consecutively, with two negative pulses or two positive pulse, then if two groups I, II are initially in the same state, the first group I is actuated when the first signal is sent and the second group II is actuated when the second signal is sent.

With this embodiment, the occurrence of a need for reinitialisation is reduced and therefore the quality of sound produced is further improved.

It could also be envisaged to provide more than two groups to further reduce the need for reinitialisation. It should be noted that the size of the loudspeaker is correspondingly increased.

The two groups preferably comprise the same number of speaklets.

The number of speaklets per group is not necessarily the same as for a digital loudspeaker according to the state of the art comprising conventional membranes. For example, it may be between 50% and 100% of the number of speaklets of a digital loudspeaker according to the state of the art. Advantageously, each of the two groups is composed of almost or exactly the same number of speaklets as a digital loudspeaker according to the state of the art in order to tend towards perfect sound reproduction. In this case, the surface area of the loudspeaker is doubled. The number of speaklets per group is determined as a function of the size and quality of sound required.

For example if a digital loudspeaker according to the state of the art comprises 200 speaklets, the digital loudspeaker in FIG. 4 comprises 200 speaklets per group, i.e. 400 speaklets.

A smaller number of speaklets in the two groups may be chosen to keep a compact size, but sufficient to make the risk of initialisation negligible.

In another embodiment shown in FIGS. 6A to 6D, the actuation means 206 comprise two actuators 206.1, 206.2. Each actuator comprises a core 208.1, 208.2 made from ferroelectric material, for example PZT, that has the property of contracting regardless of the applied voltage, and electrodes 210.1, 210.2 to apply an actuation voltage to it. The shape of the actuator 206.1 is a ring arranged on the periphery of the membrane and the shape of the actuator 206.2 is a disk located in the central part of the membrane as shown in FIG. 2.

If a voltage is applied to actuator 206.2 by electrodes 210.2, the core made of ferroelectric material 208.2 contracts inducing a torque causing a downwards movement of the membrane and generating a negative pulse.

If a voltage is applied to actuator 206.1 by electrodes 210.1, the core made of ferroelectric material 208.1 contracts inducing a torque causing an upwards movement of the speaklet and generating a positive pulse.

Figure 7A:
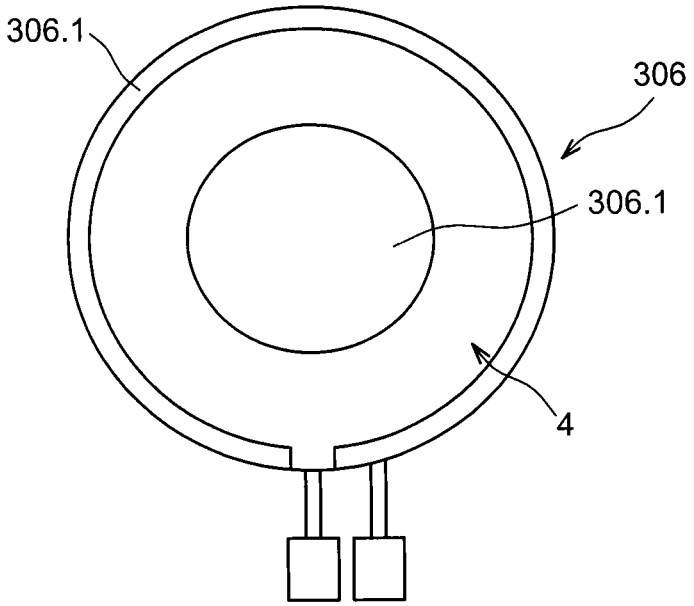
FIGS. 7A and 7B are top and sectional views respectively of another example embodiment of a membrane that can be used in the loudspeaker in FIG. 1.
Figure 7B:
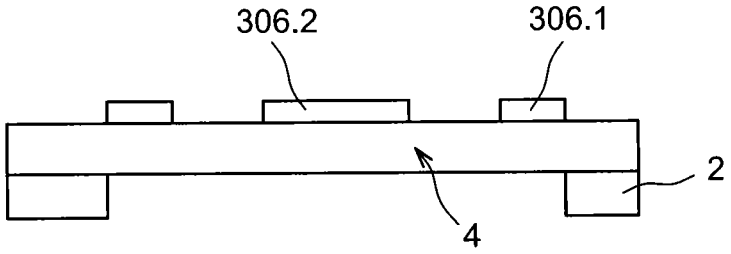

In another example embodiment shown in FIGS. 7A and 7B, the actuation means 306 are of the thermal type.

The actuation means comprise two actuators 306.1, 306.2 that have the structure of the actuators 206.1, 206.2.

The actuators 306.1 306.2 comprise a metallic motif, for example made from Al, Ti, Au, etc. that become hotter due to the Joule effect as a current passes through them. This temperature rise causes expansion of the motif due to its coefficient of expansion. This expansion will be different from the expansion of the membrane material, for example made from silicon, silicon oxide or nitride on which the actuator is deposited. This differential expansion causes a mechanical torque that induces actuation of the speaklet. When actuator 306.1 is heated, its expansion causes a downwards movement of the membrane. When actuator 306.2 is heated, its expansion causes an upwards movement of the membrane.

Figure 8A:
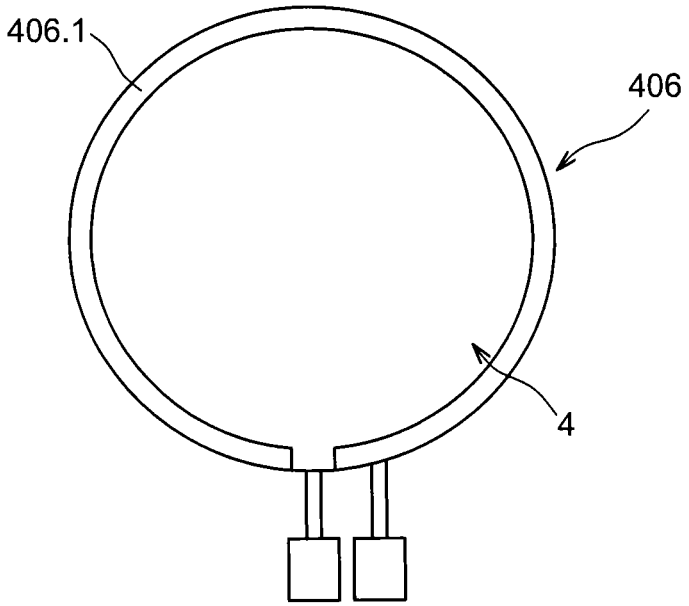
FIGS. 8A and 8B are top and sectional views respectively of a variant of the membrane in FIGS. 7A and 7B.
Figure 8B:
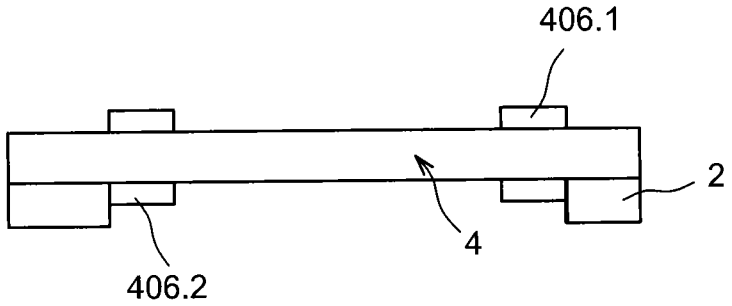

FIGS. 8A and 8B show a variant of the thermal actuation means 406 in FIGS. 7A and 7B comprising two ring-shaped actuators, one actuator 406.1 being located at the edge of the membrane on its upper face and the other actuator 406.2 being located at the edge of the membrane on its lower face. The temperature rise of the actuator 406.1 causes a downwards displacement of the membrane and the temperature rise of the actuator 406.2 causes an upwards displacement of the membrane.

In another example embodiment, the actuation means are of the electrostatic type. In this case, the potential difference applied between an electrode placed on the membrane and an electrode placed facing it, for example on the substrate or on a protective cover, induces movement of the membrane.

The actuation means are not necessarily identical for all membranes, nevertheless management of all membranes with a single actuator type is simplified and the reaction of the membranes is more uniform.

We will now describe an example method of producing an example of a bistable membrane loudspeaker according to the invention with reference to FIGS. 5A to 5F in which the steps are shown diagrammatically.

Figure 5A:
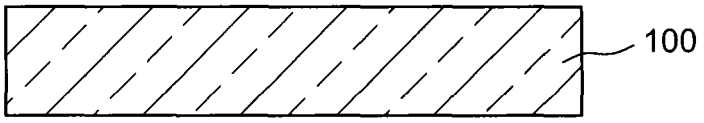
FIGS. 5A to 5F are diagrammatic views of different steps of an embodiment of a loudspeaker according to the invention.

For example, a silicon substrate 100 shown in FIG. 5A is used.

During a first step, thermal oxidation of a substrate is done so as to form an oxide layer 102 on all surfaces of the substrate, for example 2 μm thick. A hard oxide mask 104 is then deposited on the back face of the substrate. This mask may for example be 5 μm thick. To achieve this, the substrate is placed in the deposition equipment so as to leave its back face accessible. The oxide deposit is preferably done on this face alone. A photolithography step is then done to define the required motif on a resin deposited on the oxide layer. The resin is exposed so as to etch this motif in the resin. The required motif is then transferred into the oxide layer, by etching this oxide, so as to reach the silicon only in the location in which photolithography resin was removed in the exposure step.

Figure 5B:
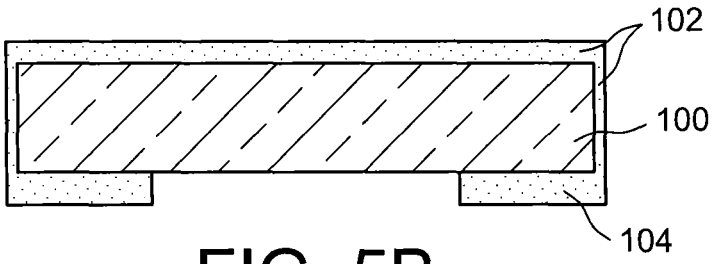

The element thus achieved is shown in FIG. 5B.

In the next step, a layer 106 is formed on the front face that will form the membrane 2. This layer may for example be made from polysilicon, SiC or $SiO_2$. The thickness of the layer 106 may for example be between a few hundred nm to several μm, or even several tens of μm.

The layer 106 may for example be made by chemical vapour deposition or by epitaxial growth. As explained previously, the internal stress in this layer is controlled to obtain a membrane with a given concavity when the membrane is released. For example, the deposition or growth of the layer 106 takes place with a predetermined compression stress level, that depends partly on deposition conditions, for example the deposition temperature, the deposition rate, etc. and partly on the composition of the material forming the membrane. The stress in the membrane that fixes the shape of the membrane after its release can be obtained by controlling the stress in one or several component layers of the membrane, which is why the layer 106 may comprise one or several materials.

Figure 5C:
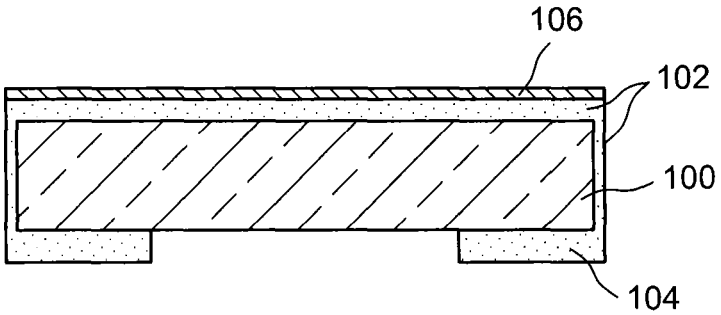

The element thus obtained is shown in FIG. 5C.

In a next step, a layer 108 is formed on the layer 106 for example made from $SiO_2$ or SiN. For example, the thickness of the layer 108 may be between a few hundred nm and several μm. The layer 108 may for example be formed by chemical vapour deposition. Once again, this layer is produced with a predetermined stress level in the same way as for layer 106.

Figure 5D:
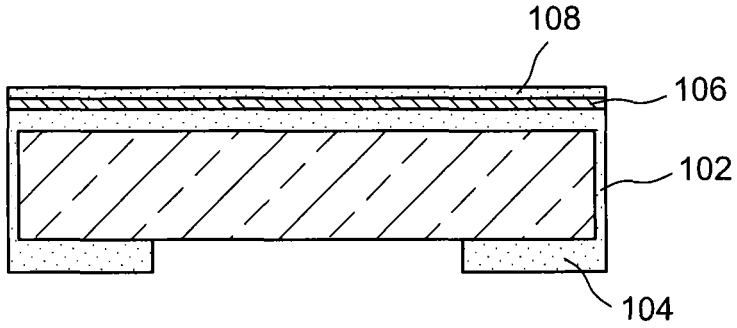

The element thus obtained is shown in FIG. 5D.

The piezoelectric actuation means are made during the next step.

This is done firstly by making a layer 110 that will form the lower electrode of the actuation means, for example made from Pt, Mo. The layer 110 is for example made by deposition on the layer 108. For example, the layer 110 may be between a few tens of nm to a few hundred nm thick.

A layer of piezoelectric material 112 is then deposited on the layer 110, for example made from PZT, AlN, ZnO, LNO with a thickness for example between a few hundred nm to a few μm or a few tens of μm.

The next step is to make the upper electrode by the formation of a layer 114 on the piezoelectric material 112, for example made from Ru, Au, for example between a few tens of nm to a few hundred nm thick.

Preferably, an additional layer 116, for example made from gold, is deposited on the layer of upper electrodes that will connect the contacts on the upper electrodes.

The layers 106 to 116 are deposited one above the other. The first step is to etch the layer 116 at the top of the stack with a photolithography mask. The layer 114 is then etched with a second mask that is preferably slightly larger than the first one, to prevent any problem in the case of a misalignment of the masks. The stepped profile in FIG. 5F is then obtained.

Figure 5E:
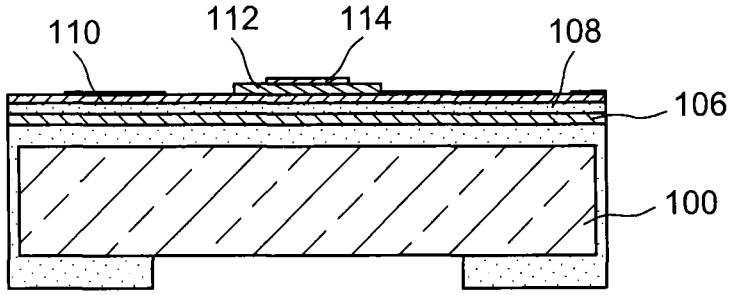
Figure 5F:
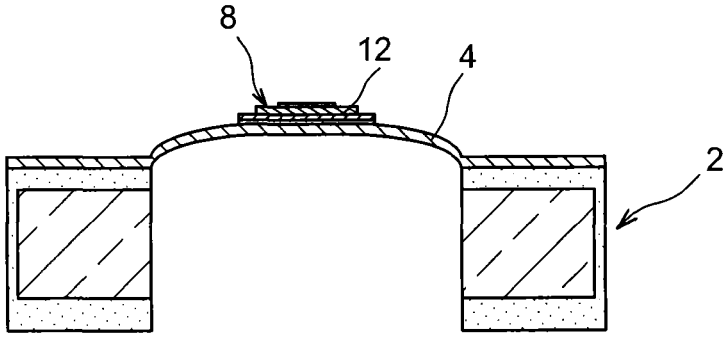
Figure 6A:
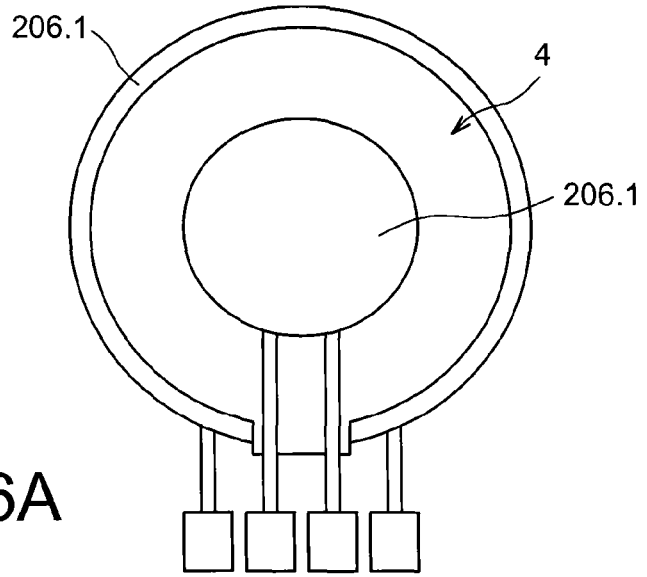
FIGS. 6A and 6B are top and sectional views respectively of another example embodiment of a membrane that can be used in the loudspeaker in FIG. 1.
Figure 6B:
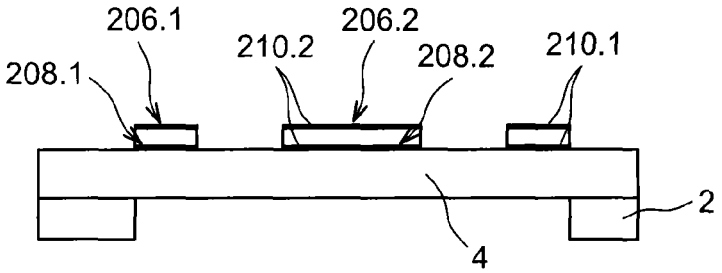
Figure 6C:
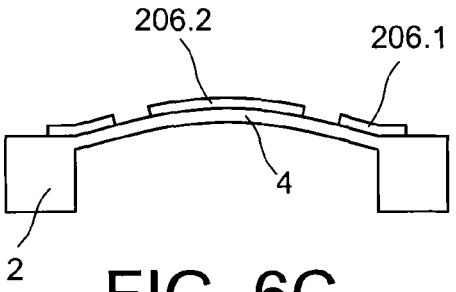
FIGS. 6C and 6D are diagrammatic views of the membrane in FIG. 6A in two actuation states.
Figure 6D:
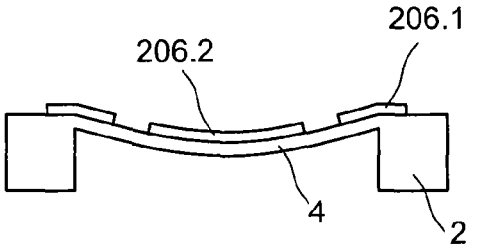

The element thus obtained is shown in FIG. 5E.

The next step is to etch the layer of the lower electrode and the layer 108, with the same mask or different masks, to define the actuator.

Finally, the membrane is released by deep etching of the substrate through the back face until reaching the membrane.

The membrane becomes curved as it is released due to the stresses in the membrane, and it moves into one of its stable states.

The loudspeaker thus obtained can be seen in FIG. 5F. The production of a single membrane is described for reasons of simplicity, however it will be understood that the method could advantageously be used to make all the membranes simultaneously.

Several methods could be envisaged to make the loudspeaker in FIG. 4 comprising two groups I, II of membranes 4, 4' in different initial states.

According to one method, during the steps to produce layers 106 and 108, different stresses could be applied in different zones of layers 106, 108 so that when the membranes are released, some are in the first stable state and others are in the other stable state.

According to another method, all membranes are made so that they are in the same stable state when they are released. A selective actuator command is then used to cause a given number of membranes to change to the other stable state before the loudspeaker is used.

According to another method, two fields of membrane matrices may be made that are all in the same stable state when they are released. The matrix fields are then cut out and a three-dimensional assembly of the control electronics and the first field of speaklet matrices and the second field of speaklets is made, this second field having been previously turned over so that at the time of the assembly, the membranes in the first field are in one stable position and the membranes in the second field are in another stable position. For example, the first and second fields are assembled in the same plane.

According to one variant, the two fields remain in the same orientation, however an actuation signal of the membranes in one plate is applied so that they changeover to the other stable state.

The invention claimed is:

1. A digital loudspeaker comprising:

a support;

a plurality of first membranes suspended on the support, said first membranes being bistable;

a plurality of first actuators, each corresponding to one of the first membranes and each configured to cause a corresponding one of the first membranes to transition between a first stable state and a second stable state; and a controller to control at least one of said first actuators through application of a control signal to the at least one of the first actuators, the control signal being withdrawn when a respective first membrane completes transition from one of the first and second stable states to the other of the first and second stable states, the respective first membrane membranes remaining in the other of the first and second stable states after withdrawal of the control signal, wherein, prior to sending the control signal, the controller sends a reinitialization signal to the at least one of the plurality of first actuators to change a state of the respective first membrane to prepare the respective first membrane to generate acoustic pressure in response to the control signal.

2. A digital loudspeaker according to claim 1, in which said first membranes form a first group of membranes, and the loudspeaker comprises at least one second group of second membranes and a plurality of second actuators, each corresponding to one of the second membranes, the first and the second actuator being controlled separately by the controller.

3. A digital loudspeaker according to claim 2, in which the first membranes and the second membranes are initially in different stable states.

4. A digital loudspeaker according to claim 2, in which the first membranes and the second membranes are initially in the same stable state.

5. A digital loudspeaker according to claim 2, in which the number of first membranes and the number of second membranes are equal.

6. A digital loudspeaker according to claim 2, in which the controller is configured to send the reinitialization signal to at least one first actuator or one second actuator.

7. A digital loudspeaker according to claim 2, in which the first actuators and/or the second actuators are piezoelectric actuators, comprising at least one element made of piezoelectric material in contact with respective membranes and control electrodes associated with each element, said control electrodes being configured to apply a control voltage to each element made of a piezoelectric material.

8. A digital loudspeaker according to claim 2, in which the first actuators and/or the second actuators are thermal actuators, each comprising an element forming an electrical resistance controlled by the controller and arranged in contact with respective membranes, each electrical resistance being capable of applying a mechanical torque to the membrane associated with it.

9. A digital loudspeaker according to claim 7, in which the piezoelectric element arranged on the membrane has a surface area equal to between 0.4 and 0.6 times the surface area of the membrane.

10. A digital loudspeaker according to claim 1, wherein the loudspeaker is made using microelectronic methods.

11. A method for making a loudspeaker according to claim 1 comprising the following steps:

a) making a layer in which the membranes will be formed;

b) making the first actuators and/or second actuators;

c) releasing membranes; and d) connecting the first actuators and/or the second actuators to the controller.

12. A method according to claim 11, in which the layer formed in step a) is made with at least one predefined stress level.

13. A method according to claim 11, in which during step a), different predetermined stress levels are applied to different zones in the layer that will form the membranes so as to form the first membranes and the second membranes that will be in different stable states when they are released in step c).

14. A method according to claim 11, in which between step c) and step d), the method further comprises cutting out the device obtained to form two sub-elements or membrane groups, and during step d), the two sub-elements are assembled and the first actuators and the second actuators are electrically connected to the controller such that the membranes of the two sub-elements are in different stable states.

15. A method according to claim 14, in which one of the sub-assemblies is turned over.

16. A method according to claim 11, in which part of the first or second actuators are actuated to force corresponding membranes to change to the other stable state.

17. The method according to claim 1, wherein the first actuators of the first membranes cause transition of the first membranes between the first stable state and the second stable state through contraction and expansion.

18. The method according to claim 17, wherein the first actuators of the first membranes cause transition of the first membranes from the first stable state to the second stable state through contraction in response to a negative voltage.

19. The method according to claim 17, wherein the first actuators of the first membranes cause transition of the first membranes from the second stable state to the first stable state through expansion in response to a positive voltage.

* * * * *